US006506133B1

(12) United States Patent
Hong

(10) Patent No.: US 6,506,133 B1
(45) Date of Patent: Jan. 14, 2003

(54) RACKET WITH APPARATUS FOR ENHANCING ELASTICITY OF NETWORK

(76) Inventor: Arthur Hong, No. 153, Sec. 3, Chung San Road, Tan Tsu Hsian, Taichung Hsien (TW)

( * ) Notice: Subject to any disclaimer, the term of this patent is extended or adjusted under 35 U.S.C. 154(b) by 0 days.

(21) Appl. No.: 10/036,382

(22) Filed: Jan. 7, 2002

(51) Int. Cl.[7] ..... A63B 49/02
(52) U.S. Cl. ..... 473/539; 473/522
(58) Field of Search ..... 473/539, 543, 473/548, 522, 534

(56) References Cited

U.S. PATENT DOCUMENTS

| | | | | | |
|---|---|---|---|---|---|
| 1,523,865 | A | * | 1/1925 | Craig | 473/542 |
| 1,526,734 | A | * | 2/1925 | Andrews et al. | 473/540 |
| 1,559,986 | A | * | 11/1925 | Quick | 473/534 |
| 3,884,467 | A | * | 5/1975 | Sommer | 473/539 |
| 4,828,259 | A | * | 5/1989 | Davis | 473/522 |
| 4,976,433 | A | * | 12/1990 | Pohlenz et al. | 473/534 |
| 5,290,031 | A | * | 3/1994 | Natsume | 473/522 |

FOREIGN PATENT DOCUMENTS

| | | | | |
|---|---|---|---|---|
| DE | 2116920 | * | 10/1972 | 473/FOR 178 |
| DE | 3145056 | * | 5/1983 | 473/FOR 178 |
| DE | 3527823 | * | 5/1986 | A63B/51/00 |
| DE | 3442428 | * | 6/1986 | G01L/5/04 |
| EP | 109087 | * | 5/1984 | 473/FOR 178 |
| GB | 2252505 | * | 8/1992 | 473/FOR 179 |

* cited by examiner

*Primary Examiner*—Raleigh W. Chiu
(74) *Attorney, Agent, or Firm*—Browdy and Neimark, P.L.L.C.

(57) ABSTRACT

A racket has a main body, which has a head frame, an Y-shaped shaft, a handle, and a network, which string the head frame. Two elastic supporting devices dispose on the head frame. Each of the elastic supporting devices has an inner member, an outer member and at least one elastic member. The inner member has a base piece, which has two stick tubes and two inner engage tubes thereon. The outer member has a base piece, which has two through holes and two outer engage tubes thereon. The outer member slidably engages to the inner member by means of the outer engage tubes engaging to the outer engage tubes. The elastic members respectively dispose on the inner and the outer engage tubes for push the outer member away from the inner member. A string of the network insert into the stick tubes, the inner and the outer engage tubes and the through holes of the outer member for providing the network an extra elasticity.

7 Claims, 3 Drawing Sheets

RACKET WITH APPARATUS FOR ENHANCING ELASTICITY OF NETWORK

FIELD OF THE INVENTION

The present invention relates generally to a game racket, and more particularly to a racket with apparatus for enhancing elasticity of network thereof.

BACKGROUND OF THE INVENTION

Rackets for tennis, badminton, squash or racketball etc., each of which has a head frame thereof stringing a network with a predetermined tension.

U.S. Pat. No. 1,542,177 taught a racket with semicircular elastic pieces disposed at a head frame of the racket. String of a network winded around the elastic pieces for increasing the elasticity of the network. U.S. Pat. No. 3,884,467 disclosed supporting devices disposed at a head frame for string winding around. The supporting devices respectively provided a spring between thereon and the head frame.

The prior art taught elastic apparatus for increasing the elasticity of the network of the racket. Whereby, the racket has a superior capacity of absorbing impact and controlling ball when hitting. The elastic apparatus of the prior art disposed at opposite ends of the string for increasing the deformed range of the network. But the network is too soft to hit the ball. Besides, the elastic apparatus will escape while the string break.

SUMMARY OF THE INVENTION

The primary objective of the present invention is to provide a racket with apparatus for enhancing elasticity of network, which has a capacity of extending the time of the ball to be in touch with network of the racket and absorbing impact to get superior performance of hitting, and more particularly it has a simple structure.

Another objective of the present invention is to provide a racket with apparatus for enhancing elasticity of network, therein the apparatus will not escape from the racket when the string is broken.

According to the objectives of the present invention, a racket comprising a main body, which has a head frame, an Y-shaped shaft and a handle. A triangle space in between the Y-shaped shaft and the head frame is defined as a throat. A network disposes at the head frame of the main body. At least one elastic supporting device disposes at the head body and in the throat. The elastic supporting device has an inner member, which has a base piece and at least one pair of stick tubes disposing at one side of the base piece. The inner member disposes at the head frame by means of inserting the stick tubes into string holes thereof. An outer member has a base piece and through holes. The outer member slidably engages to the inner member for the through holes respectively corresponding to the stick tubes of the inner member, and at least one elastic member disposed between the inner member and the outer member with one end thereof being against the inner member and the other end thereof being against the outer member, whereby a string of the network passes through the stick tubes of the inner member and the through holes of outer member for the string winding around the outer member.

DETAIL DESCRIPTION OF THE INVENTION

Figure 1:
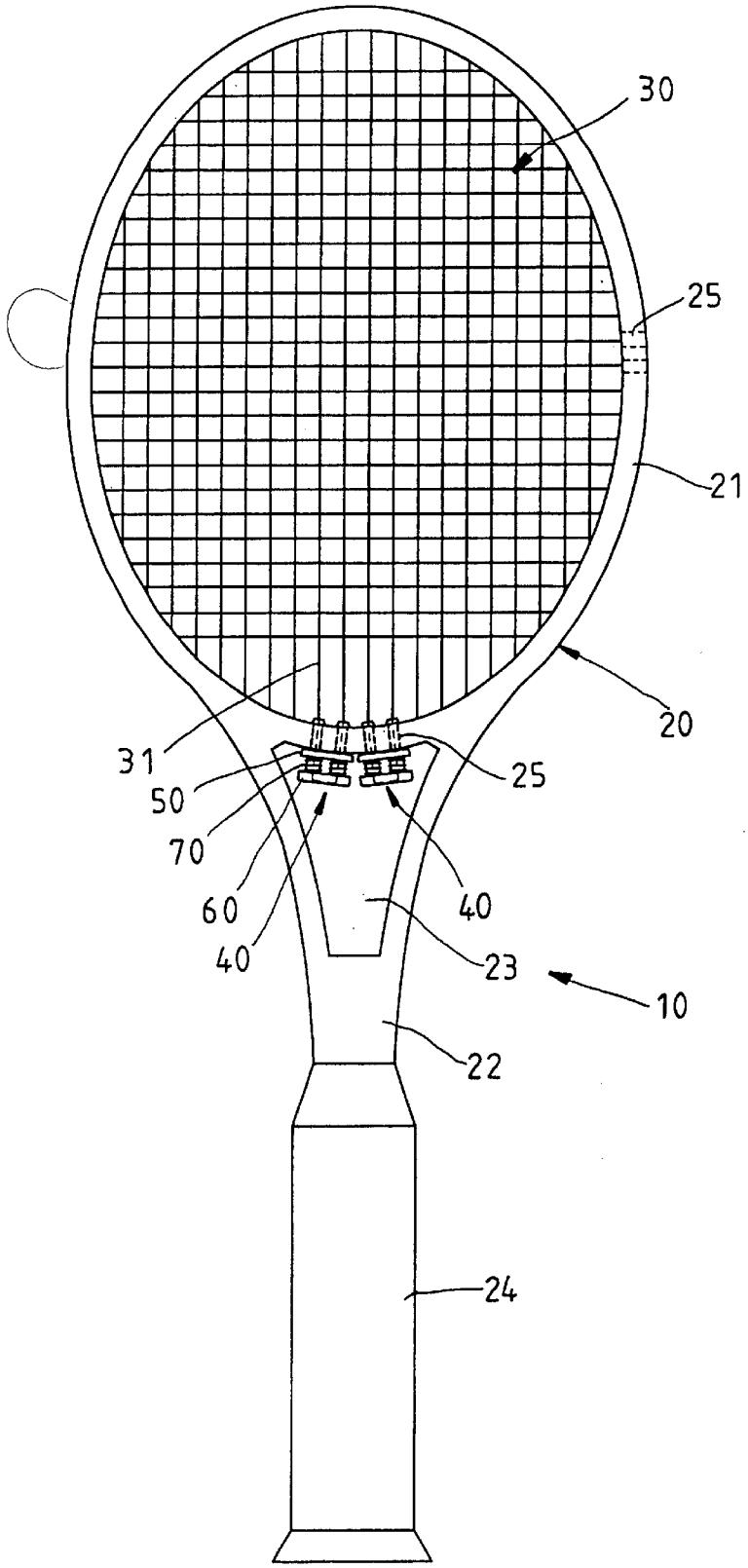
FIG. 1 is a perspective view of a first prefer embodiment of the present invention.

Please refer to FIG. 1, the first prefer embodiment of the present invention provides a racket 10. We pick a tennis racket to be an example to describe the present invention, the racket 10 of the present invention can be a badminton racket, a squash racket and the like.

The racket 10 has a main body 20, which has an oval head frame 21 and an Y-shaped shaft 22 disposed at bottom side of the head frame 21. There is a triangular space at between the proximal end of the shaft 22 and the head frame 21, which is defined as a throat 23. A handle 24 disposes at the distal end of the shaft 22 for user to grip. The head frame 21 has string holes 25 thereon. A network 30 is set at the head frame 21 by means of stringing a string 31 through the string holes 25.

Figure 2:
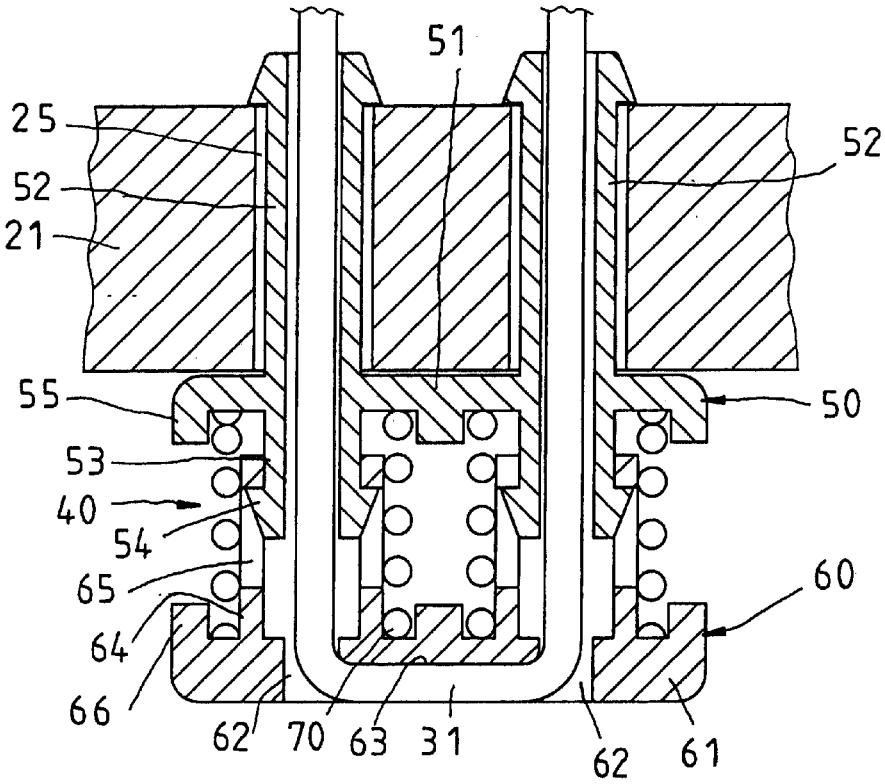
FIG. 2 is a sectional view of an elastic supporting device of the first prefer embodiment of the present invention, showing the initial position.
Figure 3:
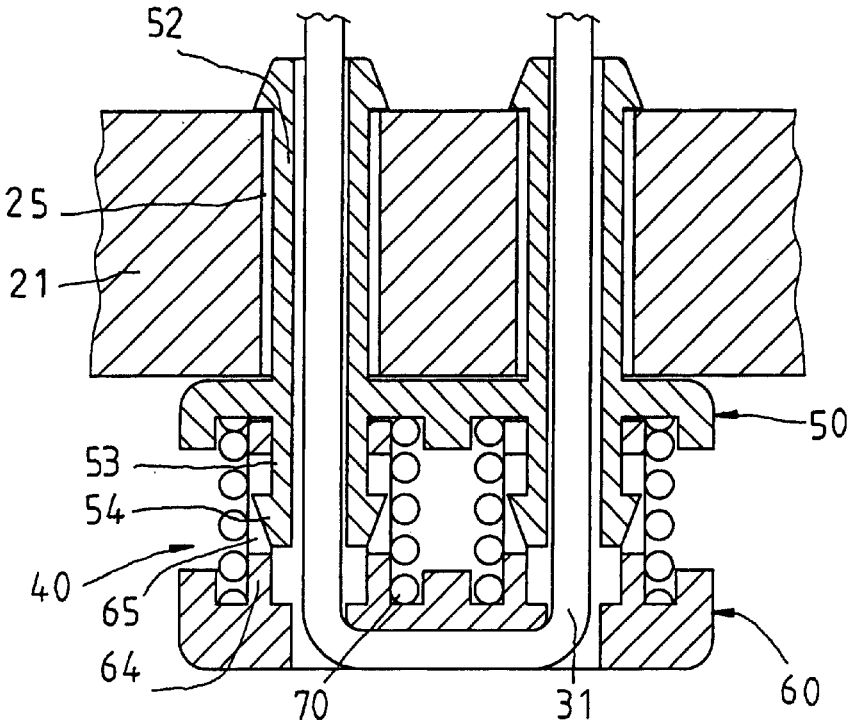
FIG. 3 is a sectional view of the elastic supporting device of the first prefer embodiment of the present invention, showing the string of the network drawing the elastic supporting device.

Please refer to FIG. 2 and FIG. 3, the present invention provides two elastic supporting devices 40 at exterior surface of the head frame 21 within the throat 23. Each of the elastic supporting devices 40 comprises elements described hereunder respectively.

An inner member 50 has an elongated base piece 51, which has two parallel stick tubes 52 at topside thereof. Each of the stick tubes 52 has a taper-shaped distal end. The base piece 51 further has two inner engage tubes 53 at bottom side thereof corresponding to the stick tubes 52 respectively. Each of the inner engage tubes 53 has a hook 54 at distal end thereof. The base piece 51 has a flange 55 orientating to the side of the inner engage tubes 53.

An outer member 60 has an elongated base piece 61, which has two through holes 62 and a slot 63 with opposite ends respectively connecting to the through holes 62. Two outer engage tubes 64 dispose at topside of the base piece 61 respectively corresponding to the through holes 62. There is a U-shaped passageway defined in the outer engage tubes 64 and the through holes 62 and the slot 63 of the base piece 61. Each of the outer engage tubes 64 has openings 65 at the wall thereof. The base piece 61 has a flange 66 orientating to the side of the outer engage tubes 64.

The outer member 60 secures at the inner member 50 by means of the out engage tubes 64 receiving the inner engage tubes 53 therein for the hooks 54 engaging to the openings 65. The outer member 60 can slide along the inner member 50 between a first position, in which the outer member 60 is away from the inner member 50 as shown in FIG. 2, and a second position, in which the outer member 60 is closing to the inner member 50 as shown in FIG. 3.

Two elastic members 70, which are two springs in this embodiment, respectively dispose on the inner and the outer engage tubes 53 and 64 having ends thereof being against the base piece 51 of the inner member 50 and having the other ends thereof being against the base piece 61 of the outer member 60. The elastic members 70 are to force the outer member 60 away from the inner member 50.

In assembling, two of the elastic supporting devices 40 mount on the exterior side of the head frame 21 of the racket positioning in the throat 23 by means of the stick tubes 52 inserting into the string holes 25. Then, stringing the head frame 21 for the string 31 passing through the stick tubes 52, the inner engage tubes 53, the outer engage tubes 64, the through holes 62 and the slot 63 of the inner and the outer members 50 and 60.

Please refer to FIG. 1, four vertical string segments 31, which pass through a sweet spot on the central of the network 30, are affected by the elastic supporting devices 40 of the preset invention. It is different from the prior art of winding the string around the head frame directly. At initial, the string 31 winds around the outer member 60 of the elastic supporting device 40 with a predetermined tension. The elastic members 70 will provide a resistant force to keep the outer member positioning at the first position as shown in FIG. 2. When hitting a ball, the string 31 will draw the outer member 60 to the second position as shown in FIG. 3.

When the racket of the present invention is hitting a ball, the network 30 will be deformed. In the meantime, the outer members 60 of the elastic supporting devices 40 will be drawn to the second position as shown in FIG. 3. Whereby the four string segments 31, which are affected by the elastic supporting devices 40, will has a larger deforming range to extend the time of the ball to be in touch with the network 30 of the racket 10 when hitting. And further more, the impact will be absorbed too. Thus, the racket 10 of the present invention has a superior capacity in controlling ball and absorbing impact. The elastic members 70 will also give a help in the network 30 recovering from the deformed status to the normal flat status after hitting. That might enhance the strength of the ball be hit.

In comparing to the prior art, the racket 10 of the preset invention is to provide the elastic supporting devices 40 to affect the four longest string segments 31 of the network 30. So, the network 30 of the present invention will be not too soft to hit ball. It provides the racket 10 of the present invention a superior performance in hitting, and more particularly, the present invention has a simple structure.

If the string 31 of the racket 10 is broken, the elastic supporting devices will not escape from the head frame 21 because of the stick tubes 52 are secured in the string holes 25 of the head frame 21. The elastic supporting device 40 can be sold independent to be a kit of the racket.

Figure 4:
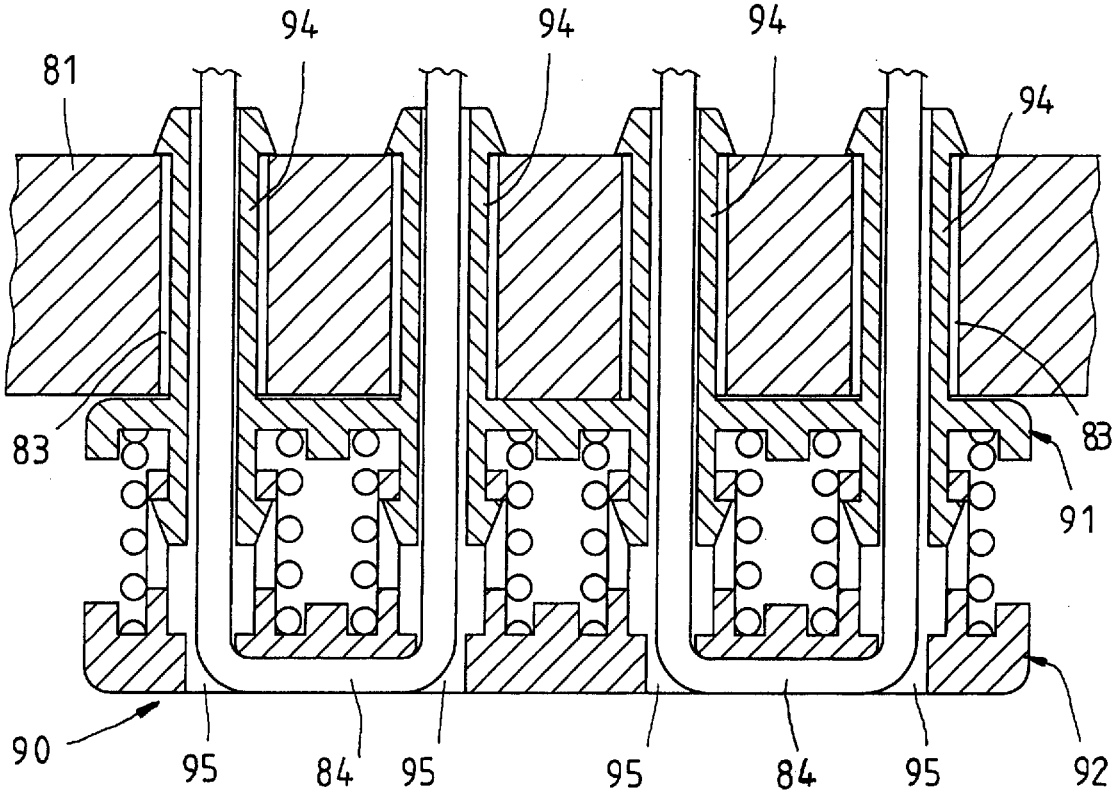
FIG. 4 is a sectional view of an elastic supporting device of the second embodiment of the present invention.

FIG. 4 shows an elastic supporting device 90 of a second prefer embodiment of the present invention. The elastic supporting device 90 has an inner member 91, an outer member 92 and four elastic members 93. Different from the elastic supporting device 40 of the first embodiment, the supporting device 90 of the second prefer embodiment has four stick tubes 94 on the inner member 91 and has four through holes 95 on the outer member 92 respectively corresponding to the stick tubes 94. The four stick tubes 94 is set to be two pairs, and each pair of the stick tubes 94 is for a string stringing in and out.

What is claimed is:

1. A racket comprising:

a main body having a head frame, an Y-shaped shaft and a handle; a space in between said Y-shaped shaft and said head frame being defined as a throat;

a network disposed at said head frame of said main body;

at least one elastic supporting device disposed at said head body and in said throat; said elastic supporting device having:

an inner member having a base piece and at least one pair of stick tubes disposed at one side of said base piece; said inner member disposed at said head frame of said main body by means of inserting said stick tubes into string holes of said head frame;

an outer member having a base piece and through holes; said outer member slidably engaging to said inner member in a manner of that said through holes respectively corresponding to said stick tubes of said inner member, and at least one elastic member disposed between said inner member and said outer member with one end thereof being against said inner member and the other end thereof being against said outer member;

whereby a string of said network passing through said stick tubes of said inner member and said through holes of outer member to wind around said outer member.

2. The racket as defined in claim 1, wherein comprises two elastic supporting devices, each of which having two stick tubes at said inner member and two through holes at said outer member.

3. The racket as defined in claim 1, wherein said elastic supporting device has four stick tubes at said inner member and four through holes at said outer member.

4. The racket as defined in claim 1, wherein said inner member further has inner engage tubes on said base piece at the side of facing to said outer member; said outer member further having outer engage tubes on said base piece at the side of facing to said inner member; said outer engage tubes respectively engaging to said inner engage tubes; said inner and said outer engage tubes respectively has a hook and a opening for keeping said outer member from escaping from said inner member.

5. The racket as defined in claim 4, wherein said elastic member is a spring disposing on said inner and said outer engage tubes having one end thereof being against said inner member and the other end thereof being against said outer member.

6. The racket as defined in claim 5, wherein said inner member has a flange at said base piece thereof substantially orientating to said outer member; said outer member having a flange at said base piece thereof substantially orientating to said inner member.

7. The racket as defined in claim 1, wherein said outer member has a slot at the exterior side of said base piece with both ends thereof connecting to said through holes respectively.

* * * * *